US006718586B2

(12) United States Patent
Corsini

(10) Patent No.: US 6,718,586 B2
(45) Date of Patent: Apr. 13, 2004

(54) INTERLOCKING STRIKING TOOL HANDLE

(76) Inventor: Ralph Corsini, 5 Mackay Rd., Bay Shore, NY (US) 11706

( * ) Notice: Subject to any disclaimer, the term of this patent is extended or adjusted under 35 U.S.C. 154(b) by 84 days.

(21) Appl. No.: 10/116,435

(22) Filed: Apr. 4, 2002

(65) Prior Publication Data

US 2002/0138915 A1 Oct. 3, 2002

Related U.S. Application Data

(63) Continuation-in-part of application No. 09/817,984, filed on Mar. 27, 2001, now Pat. No. 6,367,107.

(51) Int. Cl.[7] ..... B25D 1/04
(52) U.S. Cl. ..... 7/143; 7/145; 7/166
(58) Field of Search ..... 7/143, 145, 158, 7/159, 166, 170

(56) References Cited

U.S. PATENT DOCUMENTS

| | | | | | |
|---|---|---|---|---|---|
| D243,314 | S | | 2/1977 | Hedvall | D8/76 |
| D271,076 | S | | 10/1983 | Hillinger | D8/76 |
| D273,359 | S | | 4/1984 | Kolonia | D8/80 |
| 4,586,258 | A | | 5/1986 | Burke | 30/308.1 |
| 4,685,213 | A | | 8/1987 | Powers | 30/123 |
| D299,412 | S | | 1/1989 | Zabarte | D8/75 |
| 4,890,818 | A | | 1/1990 | Williams | 254/93 |
| 4,926,558 | A | | 5/1990 | Brace | 30/308.1 |
| 5,044,033 | A | | 9/1991 | Fosberg | 7/166 |
| 5,074,002 | A | * | 12/1991 | Huang | 7/149 |
| D324,473 | S | | 3/1992 | Chen | D8/80 |
| 5,095,623 | A | | 3/1992 | Williams | 30/144 |
| 5,105,493 | A | | 4/1992 | Lugtenaar | 7/116 |
| 5,315,724 | A | | 5/1994 | Trujillo et al. | 7/145 |
| 5,425,176 | A | | 6/1995 | Brainerd et al. | 30/308.1 |
| 5,428,853 | A | * | 7/1995 | Menke et al. | 7/138 |
| 5,701,675 | A | | 12/1997 | Hall et al. | 30/123 |
| 5,735,630 | A | | 4/1998 | Keathley et al. | 403/334 |
| 5,768,727 | A | * | 6/1998 | Brainerd | 7/145 |
| 5,871,204 | A | * | 2/1999 | Spirer | 254/26 R |
| 5,906,493 | A | | 5/1999 | Bishop | 434/226 |

* cited by examiner

*Primary Examiner*—Joseph J. Hail, III
*Assistant Examiner*—David B. Thomas

(57) ABSTRACT

A striking tool is provided for interlocking with a bar-like tool having a fork end and/or a pike end. The striking tool uses two retaining features for retaining a bar-like tool. The pike can be replaced by or supplemented with an adz, or any other type of extrusion. The bar-like tool is preferably a halligan. The striking tool is preferably an axe having a handle and a striking head anchored to the handle. Both of the bar-like-tool retaining features are located on the handle. The two tools are detachably interlocked for storage or carrying purposes. The present invention is especially useful in the firefighting field.

46 Claims, 7 Drawing Sheets

INTERLOCKING STRIKING TOOL HANDLE

This is a Continuation In Part of Ser. No. 09/817,984 filed Mar. 27, 2001 now U.S. Pat No. 6,367,107 and incorporates by reference parent U.S. Pat. No. 6,367,107 to be issued Apr. 9, 2002. The difference between the parent patent and the CIP is as follows: The parent has one of the two retaining features located on the striking head and the other on the handle. The CIP has both retaining features on the handle.

FIELD OF THE INVENTION

The present invention relates to a striking tool, and more specifically to a striking tool handle that has retaining features for detachably retaining a secondary, bar-like tool having a fork end and/or a pike end.

BACKGROUND OF THE INVENTION

Today, firefighters are required to carry a lot of equipment, including different tools that enable forcible entry into various enclosed structures. Two such tools are an axe, which is a striking tool, and a halligan, which is a bar-like tool having a fork at one end and a pike and an adz at the other end. Presently these two tools have no interconnections to each other and are carried separately, occupying both hands of a firefighter and inconveniencing him. This, in turn, reduces firefighter's efficiency and his ability to more quickly move through a burning structure while retaining the use of at least one of his hands for other purposes. Some firefighters try to overcome this problem by grasping both tools in one hand. This requires a person to have large hands and is not appropriate for every firefighter. In addition, grasping and carrying both tools in the palm of one hand is awkward and difficult on the muscles. If the firefighter loosens his grasp, even for a second, the two tools will fall out of his hand and may get lost. An alternate solution employed by some firefighters is to strap the two tools together by a separate strap. While this approach may be better then grasping both tools in one's hand, it also has disadvantages. For example, because the strap provides only a single point of attachment, the tools can still move with respect to one another other along their handles. Also, if the strap slips, the two tools will become separated. Moreover, because the strap is not attached to either one of the two tools, it can get lost. Sometimes the tools have to be lowered from a roof of a burning structure to a firefighter waiting at a lower level. In situations when the two tools are lowered separately, the time for delivery of the tools to the firefighter is increased, and precious seconds that could be used to battle the fire or help the people trapped inside the burning structure are wasted.

In other, non-firefighting environments, having both hands occupied while carrying the two tools also inconveniences the operator. In addition, because the two tools are unattached to each other, the chances of either tool getting misplaced or lost are high.

Increased efficiency can be achieved if the axe and the halligan were detachably interlocked together for carrying purposes. The firefighter, or any other operator, can carry both tools in one hand, thus leaving the other hand free. Also, in firefighting situations when the tools have to be dropped to a firefighter waiting at a lower level, the two tools could be lowered at the same time and as a single unit.

An apparatus and method are needed to overcome the problems described above.

One object of the present invention is to provide for a striking tool handle that has interlocking features for a bar-like tool, allowing the two tools to be detachably interlocked for carrying purposes.

Another object of the present invention is to provide for an axe handle that has interlocking features for a bar-like tool, allowing the two tools to be detachably interlocked for carrying purposes.

Another object of the present invention is to provide for an axe handle that has interlocking features for interlocking a halligan, allowing the two tools to be detachably interlocked for carrying purposes.

The object of the present invention is to provide for a striking tool handle that has interlocking features for interlocking a bar-like tool having a fork end and allowing the two tools to be detachably interlocked for carrying purposes.

The object of the present invention is to provide for a striking tool handle that has interlocking features for interlocking a bar-like tool having a pike end and allowing the two tools to be detachably interlocked for carrying purposes.

SUMMARY OF THE INVENTION

The present invention is a striking tool handle that has two retaining features for retaining a bar-like tool having a fork and/or an extrusion end. The extrusion end can include a pike-like member, an adz or any other type extrusion. The bar-like tool is preferably a halligan. The striking tool is preferably an axe having a handle and a striking head anchored to the handle. The striking head has blade edge and a hammer edge. Both retaining features are located on the handle. One of the bar-like-tool retaining features is located on the handle near the striking head and the other feature is located near the grip end of the handle.

The retaining feature on the handle near the striking head keeps one of the ends of the bar-like tool from movement in two of the three axis, and the retaining feature near the grip end of the handle keeps the bar-like tool from detachment in at least the third axis.

The retaining feature on the handle near the striking head can be in the form of notches, a cutout, or extrusions that conform to the shape of the fork end of the bar-like tool.

The retaining feature on the handle can be in the form of a shaped opening, a hinged cover, a strap, etc.

The tools can be interlocked for carrying or storage purposes and detached when the tools have to be used for their intended operational purposes.

BRIEF DESCRIPTION OF THE DRAWINGS

Like reference numerals used in different figures represent similar elements.

DETAILED DESCRIPTION OF THE PREFERRED EMBODIMENT

The present invention relates to a striking tool with a striking tool handle, and more specifically to a striking tool handle that has retaining features for detachably retaining a secondary, bar-like tool having a fork end and/or a pike end. More specifically, this invention relates to a striking tool handle that is designed to retain a halligan. In particular, the preferred embodiment of the present invention is an axe handle designed to interlock with a halligan used by firefighters.

Figure 1A:
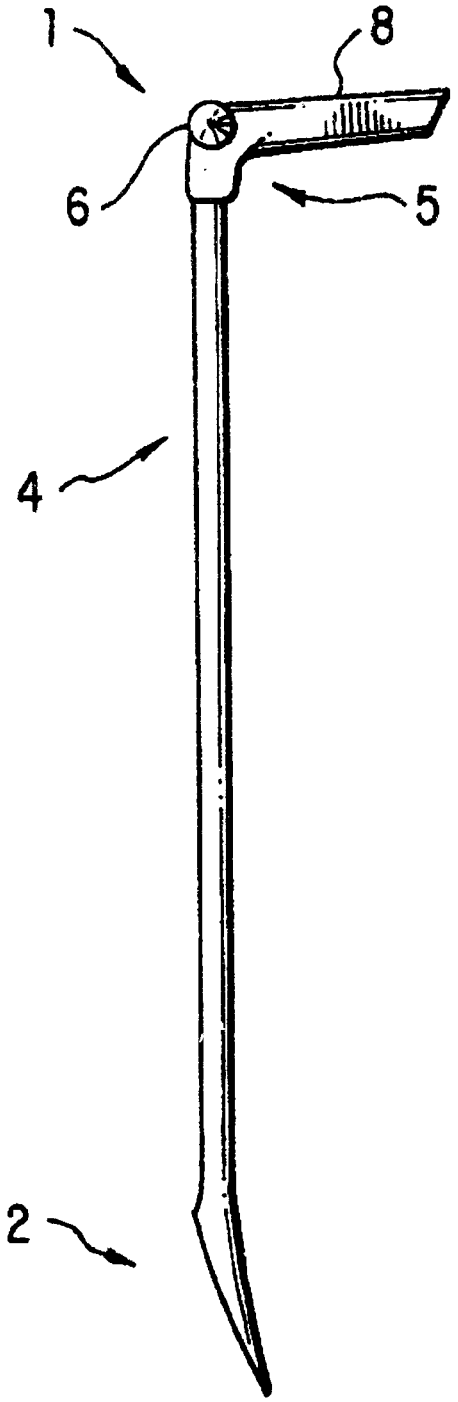
FIGS. 1*a,* and 1*b* are a side view and a front view of a bar-like tool having a fork member at one end, and a pike and an adz members at the other end.

FIG. 1*a* illustrates a side view of the bar-like tool that gets interlocked with the striking tool handle of the present invention. The bar-like tool of FIG. 1*a* is a halligan used by firefighters. The bar-like tool 1 has a first end 2, an elongated bar-like body section 4, and a second end 5. The second end 5 includes a pike 6 and an adz 8 members oriented at substantially 90 degrees to each other.

Figure 1B:
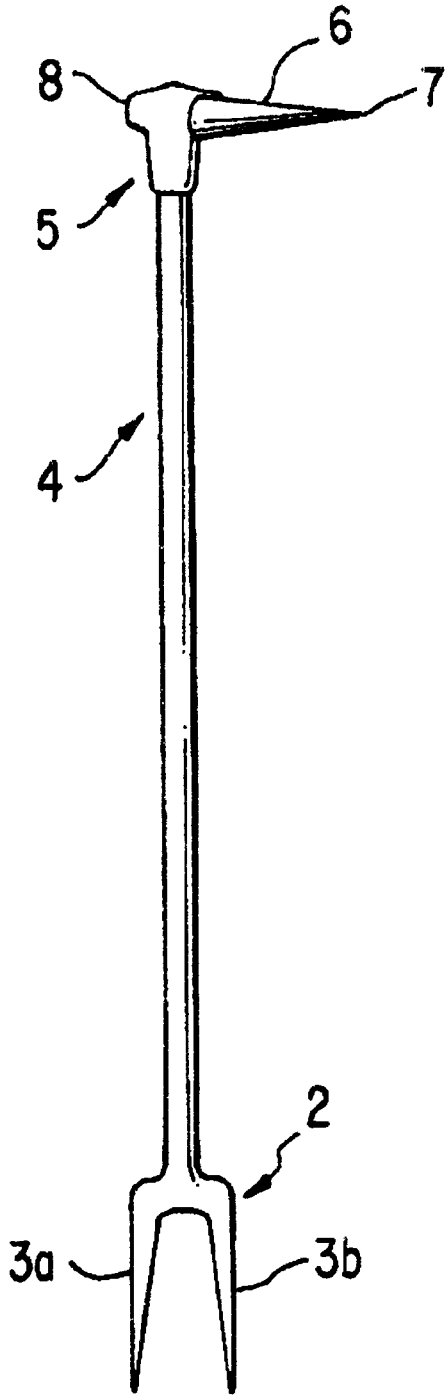
Figure 2A:
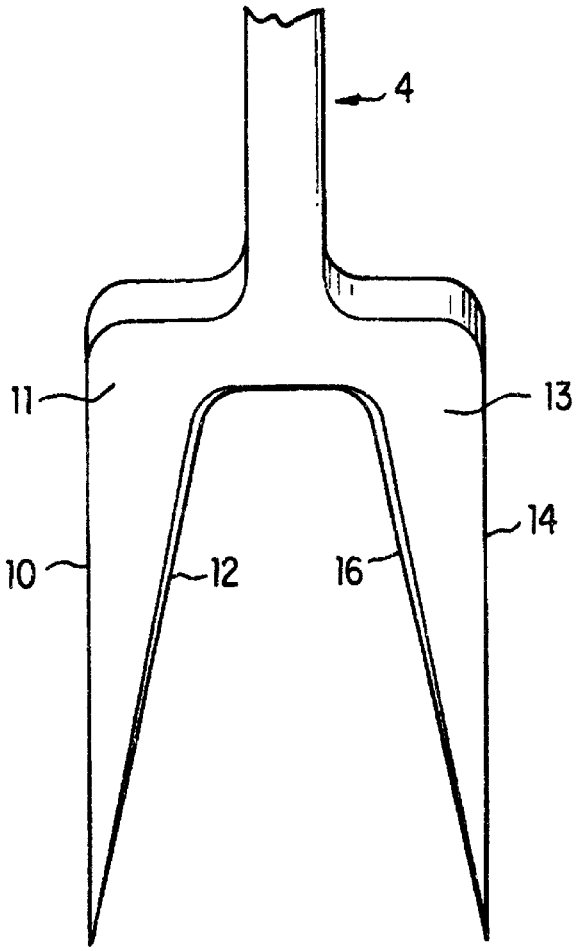
FIGS. 2*a,* 2,*b* and 2*c* show different types of fork ends of a bar-like tool.
Figure 2B:
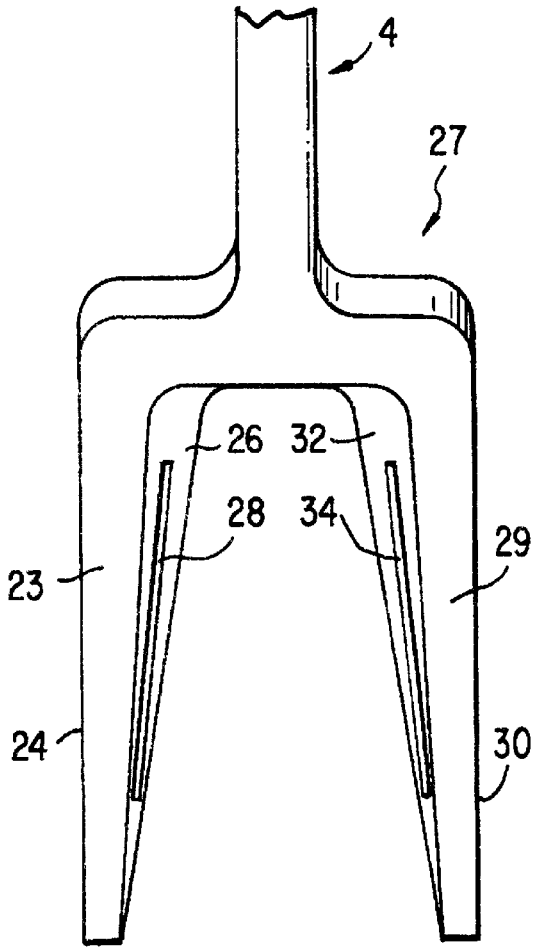
Figure 2C:
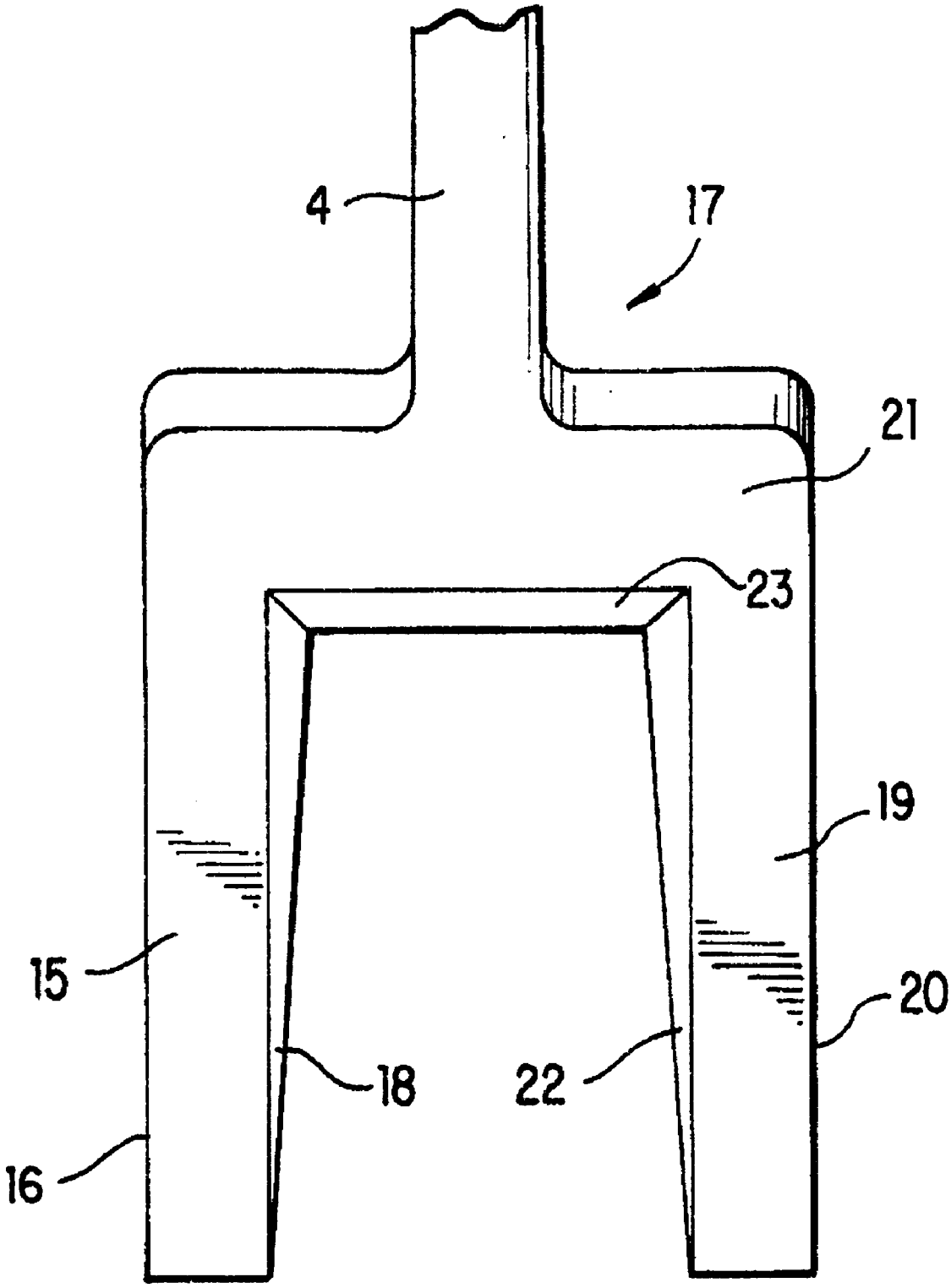

FIG. 1*b* shows the front view of the bar-like tool. The first end 2 is formed in a shape of a fork having a tapered, wedge-shaped left prong 3*a* and a tapered, wedge-shaped right prong 3*b*. The pike 6, located at the second end 5, constitutes a conical extrusion that narrows down to a pointed tip 7.

Figure 3:
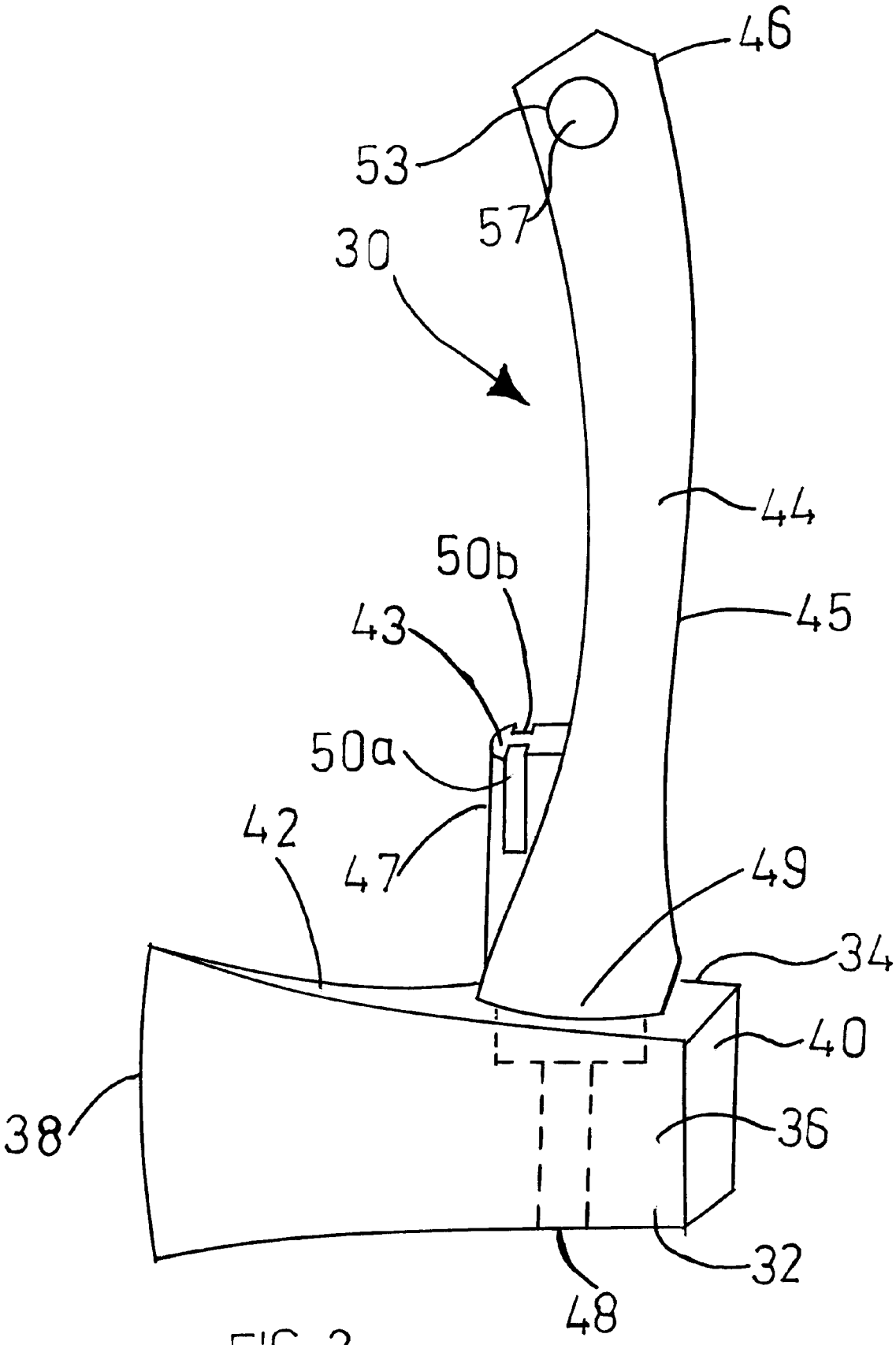
FIG. 3 illustrates a striking tool of the present invention.

The present invention provides for detachably interlocking the bar-like tool with a new striking tool handle with a striking head in the form of an axe or a hammer. One known, prior art axe has been described in U.S. Pat. No. 5,701,675, which is incorporated herein by reference. The striking tool of the present invention is an axe illustrated in FIG. 3. The axe tool 30 includes a striking head 32 and an elongated handle 44. The striking head 32 has a single piece body and two side surfaces 34 and 36. On the left side of the figure, the two side surfaces converge to a blade edge 38. On the right side of FIG. 3 the two side surfaces 34 and 36 are joined by a blunt surface 40, called hammer surface. On the top of the striking head 32, the two side surfaces 34 and 36 are joined by a top surface 42. On the handle near the striking head 32 includes a first retaining feature 47 which helps to retain the fork end of the bar-like tool and prevents it from movement along two axis. The first retaining feature includes two notches, 50*a* and 50*b*, formed in the side surfaces of the first retaining feature 47. The notches begin at the top surface 43 of the first retaining feature 47 and extend down along the side surfaces of the first retaining feature 47. The depth of each of the notches 50*a* and 50*b* depends upon the profile of the inside surface of the fork end of the bar-like tool. If the handle 44 is made out of plastic, metal or fiberglass reinforced nylon, the first retaining feature 47 can be molded at the same time as the handle.

The handle 44 includes a head-end 48, an elongated body 45 and a grip end 46. The head end 48 is inserted thought a handle-opening in the striking head, and the striking head 32 is permanently secured ("anchored") to the handle 44. Reference numeral 49 depicts the juncture at which the head-end of the handle 44 joins or enters the striking head 32.

Figure 4:
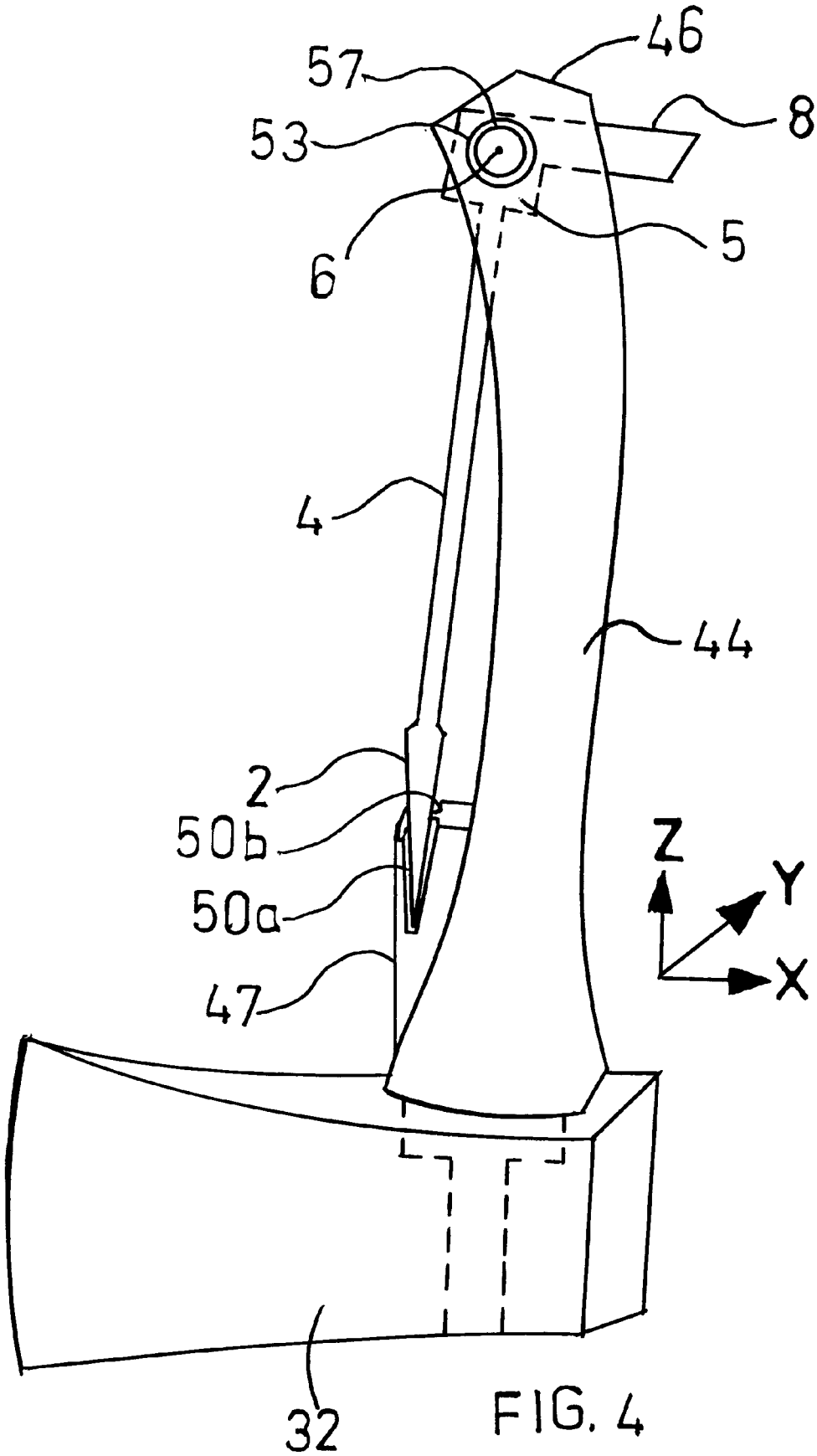
FIG. 4 illustrates the striking tool of the present invention retaining a secondary tool.

The grip end 46 is located at the other end of the handle 44. The grip end is used by an operator to hold the axe 30. The elongated body 45 joins the two ends of the handle 44 and includes a second retaining means, eyelet 53. The handle is preferably made out of a flexible material, such as wood, plastic, metal or fiberglass reinforced nylon. The second retaining feature is an eyelet 53. If the handle 44 is made out of plastic, metal or fiberglass reinforced nylon, the eyelet 53 and first retaining feature 47can be molded at the same time as the handle. If the handle 44 is made out of wood, the eyelet 53 can be also be carved out at the time when the handle is carved. The eyelet defines opening 57. FIG. 4 illustrates how the striking tool of FIG. 3 interlocks with the bar-like tool of FIG. 1*a*. The three orthogonal axis are drawn next to the interlocked tools in order to help with the understanding of the invention. The tools are interlocked together as follows. The operator straddles the fork end 2 of the bar-like tool over and onto the first retaining feature 47 near the striking head 32, such that the two prongs of the fork 2 are guided by the two notches 50*a* and 50*b* in Z-axis along their lengths. When the fork 2 of the bar-like tool is fully saddled ("seated") on the first retaining feature 47 near the striking head 32, the first retaining feature 47 near the striking head retains the fork 2 and prevents it from detachment from the first retaining feature 47 along the X and Y axis. The width of the notches on the striking head is slightly bigger then the width of the fork prongs to allow saddling of the fork along the notches, and for slight rotation of the second end (pike member)of the bar-like tool to allow it to line up with the second retaining feature on the striking tool handle. Once straddled, the only way the fork end 2 of the bar-like tool can be separated from the first retaining feature 47 is by being lifted up along the Z-axis. In order to fully interlock the two tools, the operator, while pulling or holding the body section 4 of the bar-like tool close to the pike member 5 with one hand, must push the grip end 46 of the handle 44, thereby slightly flexing the handle of the striking tool and slightly rotating the pike 6 for alignment of the tip of the pike member with the plane of the opening 57 of the eyelet 53. Once the tip of the pike member 6 is aligned with the plane of the opening 57, the flexing force is removed, the handle is allowed to flex back into its relaxed position and the pike member is inserted through the opening 57. When the pike member is fully inserted into the opening 57, the second end (the pike end) of the bar-like tool is prevented from detaching from the striking tool along the Z-axis and the X-axis. Therefore, the two retaining features in combination, one on the handle near the striking head 32 and the other on the handle 44 near the grip end 46, interlock the bar-like tool and the striking tool.

Figure 5:
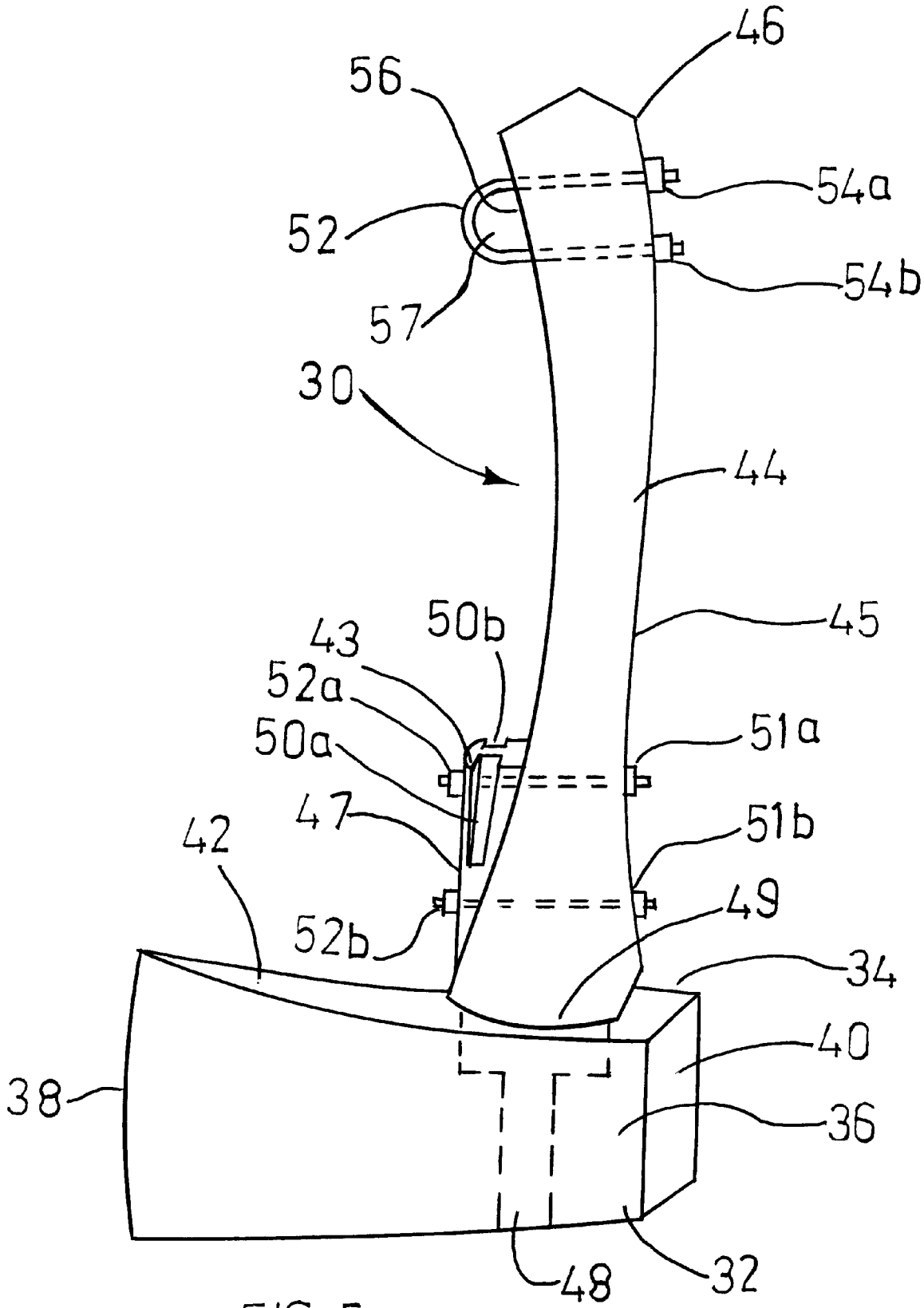
FIG. 5 illustrates an alternate embodiment of the striking tool handle of the present invention.

In order to separate the two tools, the procedure described above must be reversed. The handle 44 must be flexed to allow removal of the pike 6 out of the opening 57. Once the tip of the pike member clears the plane of the opening 57, the pike is allowed to rotate past the eyelet 53 and the flexing force is removed. At this point, to fully detach the two tools, the operator must lift the bar-like tool along the Z-axis, thereby unsaddling the fork member 2 from the first retaining feature near the striking head 32. FIG. 5 illustrates an alternative embodiment of the invention. The eyelet 53 of FIG. 3 has been replaced by a U-shaped bolt. A U-shaped bolt secured to the body portion of the handle. In the embodiment of FIG. 5, the U-shaped bolt passes through the body portion of the handle and is secured to the handle by two nuts 54*a* and 54*b*. The U-shaped bolt 52 and a corresponding surface 56 of the elongated body portion 45 define an opening 57. The length of the bar-like tool dictates position of the U-shaped bolt 52 on the handle 44. The first retaining feature 47 can be pre-molded out of metal, plastic or nylon and fastened to the handle 44 by nut 51*a*, bolt 52*a*, nut 51*b*, bolt 52*b*, screwing, or clamping.

As can be gathered from the above embodiments, the first retaining feature on the handle near the striking head can include notches, extrusions or a cutout. The second retaining feature in the handle of the striking tool can include a U-shaped bolt, an integral eyelet or any other element that forms an opening for a pike member. It should also be noted that instead of retaining the pike member, the second retaining feature can be designed to retain the adz of the bar like tool.

Figure 6:
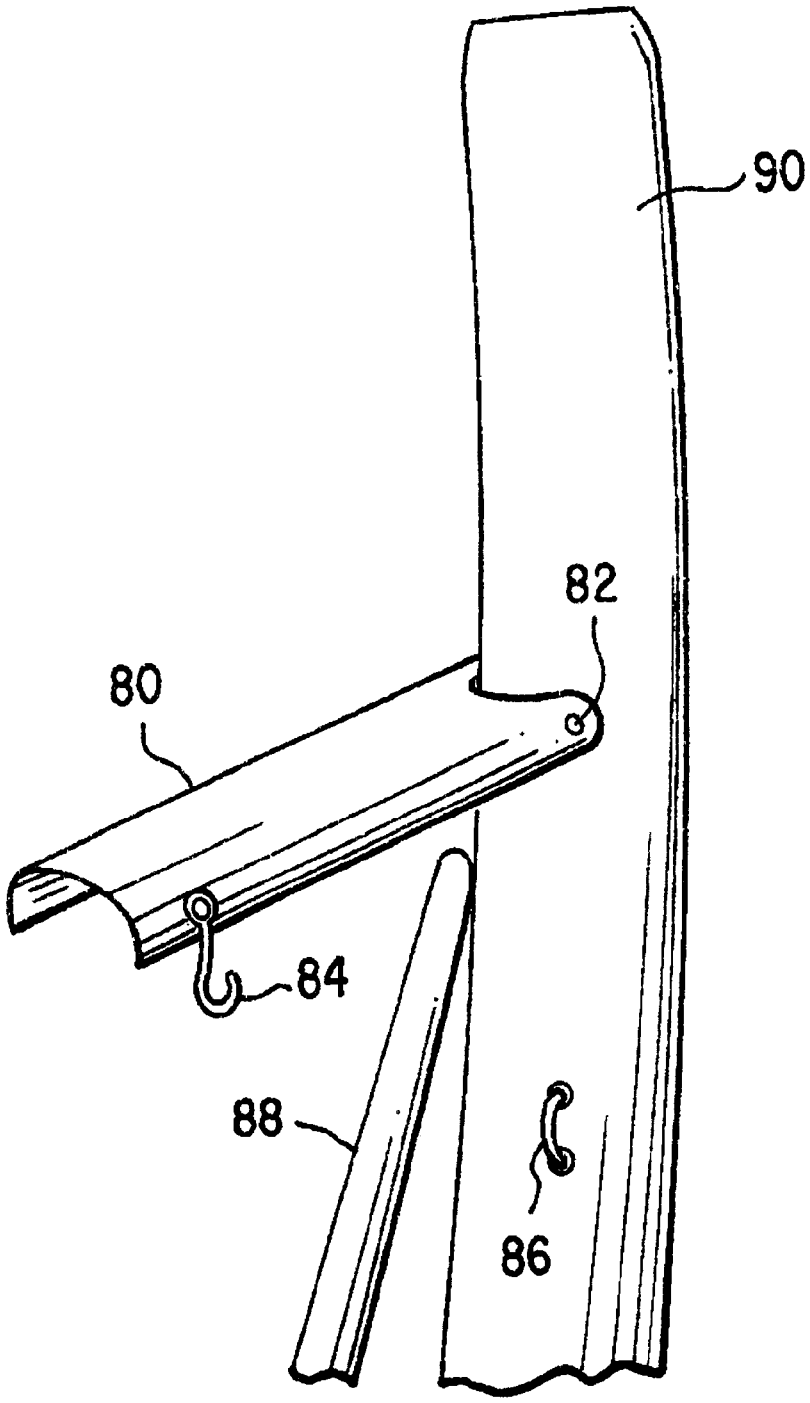
FIG. 6 illustrates an alternate embodiment of a retaining feature located on the handle of the striking tool of the present invention.

Alternately, the second retaining feature can comprise a hinged, locking cover in combination with a loop shown in FIG. 6. The cover 80 includes a hinge 82 and one or more a fasteners 84, such as hooks, snaps or Velcro. For each of the fasteners on the cover, there are corresponding fasteners 86 on the handle, as shown in FIG. 6. The interlocking of the two tools proceeds as follows. The fork member of the bar-like tool is saddled over the striking head and the non-fork end 88 of the bar-like tool would be leaned onto the handle 90 of the striking tool with the hinged cover 80 in an open position. The cover would then be brought down (closed), covering the non-fork end 88 of the bar-like tool, and secured by fastener(s) 84 to the corresponding fastener (s) 86 on the handle body. Because the cover 80 prevents the bar-like tool from moving up the handle along the Z-axis, the combination of the retaining feature on the striking head and the cover will interlock the two tools.

Other embodiments of the retaining features on striking tool handle are possible. As long as the retaining features on the striking tool handle cooperate to interlock the striking tool handle to a bar-like tool the objective of the present invention is achieved.

This invention is particularly useful in the field of firefighting. In operation, the two tools are interlocked for storage and carrying purposes as a single unit. The unit can be carried in one hand or lowered from a rooftop to a firefighter standing at a lower level. This prevents tools from being misplaced or lost and improves the operator's efficiency.

While the present invention has been described by reference to a few specific embodiments, it should be understood that modifications and variations of the invention may be constructed without departing from the spirit of the invention and the appended claims.

I claim:

1. A striking tool with a handle, used by an operator to strike an object, said striking tool handle allowing for detachable interlocking with a bar-like tool having a first end, a body section and a second end, said striking tool comprising:

a striking head having a one-piece body; and an elongated handle having a head-end attached to said striking head;

near the head-end on the handle having a first retaining feature;

a grip-end held by the operator; and an elongated body connecting the head-end and the grip-end, and near the grip-end on the handle having a second retaining feature;

said first retaining feature and said second retaining feature providing for detachable interlocking between said striking tool and the bar-like tool and allowing said striking tool and the bar-like tool to be carried as a single unit when interlocked.

2. The striking tool of claim 1, wherein said first retaining feature retains one of the two ends of the bar-like tool and prevents detachment of the retained end the bar-like tool from said first retaining feature near the striking head along a first and a second axis, and said second retaining feature prevents detachment of the bar-like tool from said striking tool.

3. The striking tool of claim 2, wherein the bar-like tool has a fork member at its first end and said first retaining feature near the striking head accepts the fork member in a straddle position.

4. The striking tool of claim 3, wherein said first retaining feature comprises a notch on each of said side surfaces of said first retaining feature near the striking head, and the fork member of the bar-like tool is straddled over said first retaining feature near the striking head along said notches.

5. The striking tool of claim 3, wherein said first retaining feature comprises a cutout at a surface top of said first retaining feature near the striking head and the fork member of the bar-like tool is straddled over said cutout.

6. The striking tool of claim 3, wherein said first retaining feature comprises an extrusion on each of said side surfaces of said first retaining feature near the striking head and the fork member of the bar-like tool is straddled over said first retaining feature near the striking head along said extrusions.

7. The striking tool of claim 3, wherein said second retaining feature retains the second end of the bar-like tool.

8. The striking tool of claim 7, wherein the bar-like tool has a pike member at its second end, said second retaining feature has an opening therethrough and retains the pike member of the bar-like tool in said opening.

9. The striking tool of claim 8, wherein said second retaining feature prevents detachment of the bar-like tool from said striking tool when said body portion of said handle is in a relaxed position, and allows attachment and detachment of the bar-like tool when said body portion of said handle is in a flexed position.

10. The striking tool of claim 9, wherein said second retaining feature comprises a U-shaped bolt securely attached to said body portion of said handle and wherein said opening is bounded by a concave surface of said U-shaped bolt and a corresponding part of a surface of said body portion of said handle.

11. The striking tool of claim 9, wherein said retaining feature is formed as an integral part of said body portion of said handle.

12. The striking tool of claim 1, wherein said handle is made out of a fiberglass reinforced nylon material.

13. The striking tool of claim 1, wherein handle is made out of a wood.

14. The striking tool of claim 1, wherein the bar-like tool is a halligan.

15. The striking tool of claim 1, wherein said striking tool is an axe.

16. The striking tool of claim 2, wherein the bar-like tool has a fork member at its first end and said first retaining means constitutes a channel in the handle near the striking head, with the fork member being inserted through said channel.

17. The striking tool of claim 16, wherein said channel passes between said two side surfaces of said first retaining feature on the handle near the striking head.

18. The striking tool of claim 16, wherein said channel is located above a juncture of said striking head and said elongated handle.

19. The striking tool of claim 16, wherein said second retaining feature retains the second end of the bar-like tool.

20. A method of interlocking a bar-like tool having a fork end and a second end to a striking tool handle having a striking head, said handle having a first retaining feature and a second retaining feature respectively, said method comprising:

a) straddling said fork end of said tool over a pair of side surfaces of said first retaining feature located on the handle near the striking head to provide a first support for said bar-like tool and to prevent said fork end from detaching from said striking head along a first axis and a second axis; and b) securing said bar-like tool in an area of said second end via said second retaining feature to prevent said bar-like tool from movement along at least a third axis;

whereby said striking tool and said bar-like tool are detachably interlocked together for carrying as a single unit.

21. The method of claim 20, wherein said first retaining feature comprises a notch on each of said side surfaces of the first retaining feature located on the handle near the striking head, and wherein the step of straddling said fork end of said bar-like tool comprises straddling said fork end along said notches.

22. The method of claim 20, wherein said first retaining feature comprises a cutout at a top surface of said first retaining feature located on the handle near the striking head, and wherein the step of straddling said fork end of said bar-like tool comprises straddling said fork end over said cutout.

23. The striking tool of claim 20, wherein said first retaining feature comprises an extrusion on each of said side surfaces of said first retaining feature located on the handle near the striking head, and wherein the step of straddling said fork end of said bar-like tool comprises straddling said fork end along said extrusions.

24. The method of claim 20, wherein the step of securing said bar-like tool comprises securing said bar-like tool at said second end.

25. The method of claim 20, wherein said bar-like tool has a pike member at said second end, said second retaining feature comprises a bounded opening, and said step of securing said second end of said bar-like tool to said elongated handle further comprises the following steps:

a) applying a bending force in order to flex said elongated handle;

b) inserting said pike member through said opening while said handle is in a flexed state; and c) removing the bending force in order to relax said elongated handle and to secure said pike member inserted through said opening to said elongated handle.

26. The method of claim 25, wherein said handle is made out of wood.

27. The method of claim 25, wherein said handle is made out of plastic.

28. The method of claim 25, wherein said handle is made out of fiberglass reinforced nylon material.

29. The method of claim 25, wherein a U-shaped bolt is securely attached to a body portion of said elongated handle and wherein said opening is bounded by a concave surface of said U-shaped bolt and a part of a surface of said body portion of said handle.

30. The striking tool of claim 25, wherein said opening is formed as an integral part of said body portion of said handle.

31. The method of claim 20, wherein said bar-like tool is a halligan.

32. The method of claim 20, wherein said striking tool is an axe.

33. A method of interlocking a bar-like tool having a pike end and a body section with a striking tool having a striking head and an elongated handle, said elongated handle having a first retaining feature on the handle and second retaining feature, said method comprising:

c) inserting said pike end of said bar-like tool through an opening in said first retaining feature to prevent said pike end from detaching from said first retaining feature along a second axis and a third axis; and d) securing said body section of said bar-like tool within said second retaining feature of said handle to prevent said bar-like tool from movement along a first axis;

whereby said striking tool and said bar-like tool are detachably interlocked together for carrying as a single unit.

34. The method of claim 33, wherein said second retaining feature comprises a snap-in element, and the step of securing further comprises the step of inserting at least a part of said body section of said bar-like tool into said snap-in element.

35. The method of claim 34, wherein said snap-in element comprises a metal spring attached to a body of said handle.

36. The method of claim 34, wherein said snap in element is positioned on said handle.

37. The method of claim 33, wherein said bar-like tool is a halligan.

38. The method of claim 33, wherein said striking tool is an axe.

39. An axe for detachably interlocking with a bar-like tool having a fork end and a pike end, said axe comprising:

an axe-head having a one-piece body with two side-surfaces;

a flexible elongated axe-handle having a head-end attached to said axe-head; and a fork retaining feature for accepting the fork end of the bar-like tool in a straddle position and preventing movement of the fork end along a first and second axis; and a grip-end; and a handle-body connecting said head-end and said grip end, and having an opening for detachably retaining the pike end of the bar-like tool and preventing movement of the pike end along at least a third axis;

whereby said axe is detachably interlocked with the bar-like tool.

40. The axe of claim 39, wherein said opening prevents detachment of the bar-like tool from said striking tool when said handle-body is in a relaxed position, and allows attachment and detachment of the bar-like tool when said handle-body is in a flexed position.

41. The axe of claim 40, wherein said opening is formed by an attachment of a U-shaped bolt to said handle-body, whereby said opening is bounded by a concave surface of said U-shaped bolt and a corresponding part of a surface of said handle-body.

42. The axe of claim 40, wherein said opening is molded into said handle-body.

43. The axe of claim 39, wherein said handle is made out of a fiberglass reinforced nylon material.

44. The axe of claim 39, wherein handle is made out of a wood.

45. The axe of claim 39, wherein handle is made out of metal.

46. The axe of claim 39, wherein said bar-like tool is a halligan.

* * * * *